United States Patent [19]

Sams

[11] 4,011,813

[45] Mar. 15, 1977

[54] LABEL DISPENSING AND APPLYING APPARATUS

[75] Inventor: Bernard Sams, London, England

[73] Assignee: Norprint Limited, England

[22] Filed: May 20, 1975

[21] Appl. No.: 579,139

Related U.S. Application Data

[62] Division of Ser. No. 283,212, Aug. 23, 1972, Pat. No. 3,890,188.

[30] Foreign Application Priority Data

Aug. 25, 1971 United Kingdom ..... 39850/71
Jan. 29, 1972 United Kingdom ..... 4305/72

[52] U.S. Cl. ..... 101/288; 101/333
[51] Int. Cl.[2] ..... B41F 1/08
[58] Field of Search ..... 101/289, 293, 291, 290, 101/31, 108, 110, DIG. 3, 292, 334, 359, 333; 156/384; 226/62, 67, 68, 69

[56] References Cited

UNITED STATES PATENTS

| | | | |
|---|---|---|---|
| 3,119,328 | 1/1964 | Pittman et al. | 101/288 |
| 3,197,104 | 7/1965 | Brethen | 226/67 |
| 3,343,485 | 9/1967 | Loeffler | 101/288 |
| 3,477,627 | 11/1969 | Webers | 226/62 X |
| 3,551,251 | 12/1970 | Sato et al. | 156/384 |
| 3,611,929 | 10/1971 | Schrotz | 101/292 |
| 3,741,847 | 6/1973 | Yo Sato | 156/384 |
| 3,745,083 | 7/1973 | Aungst et al. | 156/384 |
| 3,782,279 | 1/1974 | Carboni, Jr. et al. | 101/288 |
| 3,817,177 | 6/1974 | Arnam et al. | 101/288 |
| 3,867,883 | 2/1975 | Styers et al. | 101/125 |

*Primary Examiner*—Edgar S. Burr
*Assistant Examiner*—Paul J. Hirsch
*Attorney, Agent, or Firm*—McGlew and Tuttle

[57] ABSTRACT

A hand-held label dispensing and applying apparatus includes a label applying roller adjacent dispensing edge member which serves to detach individual labels from a strip of labels having spaced notches along its length. Labels are advanced from a store to the dispensing edge member by a movable member carrying barbs which engage the strip notches to carry the strips back to a second series of barbs and to print the label on the movable member by a print-head assembly. The movable member effectively forms a printing platen. When the movable member returns to its rest position, the second series of barbs draw a fresh label over the dispense member since they have become engaged with a fresh length of the strip.

8 Claims, 4 Drawing Figures

LABEL DISPENSING AND APPLYING APPARATUS

RELATED APPLICATION

This application is a division of my application Ser. No. 283,212 filed Aug. 23, 1972 now U.S. Pat. No. 3,890,188, issued June 17, 1975.

BACKGROUND OF THE INVENTION

1. Field of the Invention

This invention relates to self-adhesive label printing and applying devices, generally known as label applicators.

2. Description of the Prior Art

In hand held label dispensing and applying apparatus hitherto proposed, a strip or web of labels has been advanced through the apparatus by engagement of apertures in the web by single feed pawl. Such an arrangement is described in U.S. Pat. No. 3,741,847 to Yo Sato issued June 26, 1973. Such pawls are, however, unsatisfactory because there is a substantial risk that the web will be torn.

SUMMARY OF THE INVENTION

According to the present invention there is provided a label applicator comprising a casing, a label-carrying web store mounted on the casing, a print head assembly mounted within the casing, means adjacent such assembly for detaching a printed label from the web, a first barbed member movable relative to the casing and arranged to engage the web, a second barbed member substantially fixed relative to the casing and means for actuating the first barbed member whereby to draw a fresh length of web over the barbs of the second barbed member during a first part of the applicator working cycle, the second part of the working cycle causing the fresh length web to engage the barbs of the second barbed member and draw a length of web from the store equal to one label length and simultaneously to detach a label, printed during the working cycle, by passage of the web over the detaching means.

Further according to the present invention there is provided a label applicator comprising a casing having a label web reel carrier, means for applying a label dispensed from the applicator onto an article, a slide member of arcuate shape slidable in an arcuate track of the casing and carrying a trigger-like actuating projection, an elongate arcuate barbed member carried by the casing and carrying two series of barbs, one series being disposed adjacent each longitudinal edge of the fixed barbed member and a platen on which a label about to be dispensed can be printed, this platen being mounted on the slide member adjacent the applying means and carrying barbs arranged to engage a label web and a dispensing edge for detaching successive printed labels, printing means mounted in the casing and ink pad means mounted on the slide member, the ink pad means carrying a cam follower co-operating with a cam arrangement, the follower acting, during a rearward stroke of the slide member, to ink operative print facets of the printing means and to print a label on the platen, and the barbs of the platen serving to draw the web rearwardly so that a fresh length of web is presented to the fixed barbed member, the fixed barbed member serving, on a forward stroke of the slide member, to draw from the reel a length of web equal to one label pitch and to detach a printed label from the web by drawing it over the dispensing edge.

Still further according to the present invention there is provided a label applicator comprising a label web store, a print head assembly, means for dispensing labels printed by the assembly and actuating means operative to print and to dispense a given label derived from the store in the same operational cycle, the actuating means including a first series of barbs and a second series of barbs, the first series being movable in one direction to bring a fresh length of the label-carrying web into engagement with the barbs of the second series which barbs are substantially fixed relative to the applicator as a whole, and the second series of barbs serving to hold the web as the first series moves in the opposite direction whereby to draw a printed label to the dispensing means and dispense the label.

DESCRIPTION OF THE PREFERRED EMBODIMENT

The applicator about to be described is intended for use with a band or web of self-adhesive labels having accurately regularly-spaced indents or notches along the whole of the length of a backing strip. Other bands, however, can also be used. The indents or notches may be provided either at both longitudinal edges of the backing strip, or centrally, or possibly at one longitudinal edge only. It should be emphasized that the exact form of the web of labels is not critical provided that some form of accurately, regularly-spaced indents, notches, or other engagement means is provided which can be positively engaged by a part or parts of the mechanism of the applicator. The applicator to be described is intended to serve to print data, such as prices and stock coding, on each label immediately prior to applying such label onto an article, the backing strip on which the labels are mounted being deflected away from the labels immediately adjacent to the point of application to an article, and the spent backing strip being discharged at the point remote from a point of application of the labels.

The applicator includes a casing 1110 having a handle portion 1112, a label reel store portion 1114 with a central boss 1116 on which a reel 1118 is mounted for rotation, and a detachable printing assembly 1120. A label application device 1122 carries a pad 1124 and is fastened to the casing 1110 by a self-tapping screw 1126.

The assembly 1120 comprises print wheels 1128 entrained with corresponding read-out wheels 1130 and setting wheels 1132. The wheels 1132 may be selectively rotated by means (not shown) accessible from outside the casing 1110 to select operative type facets. When the selected characters on the print wheels 1128 are in the print position 1134, corresponding characters on the display wheels 1130 are visible from outside the body 1110 through a window 1136.

Figure 3:
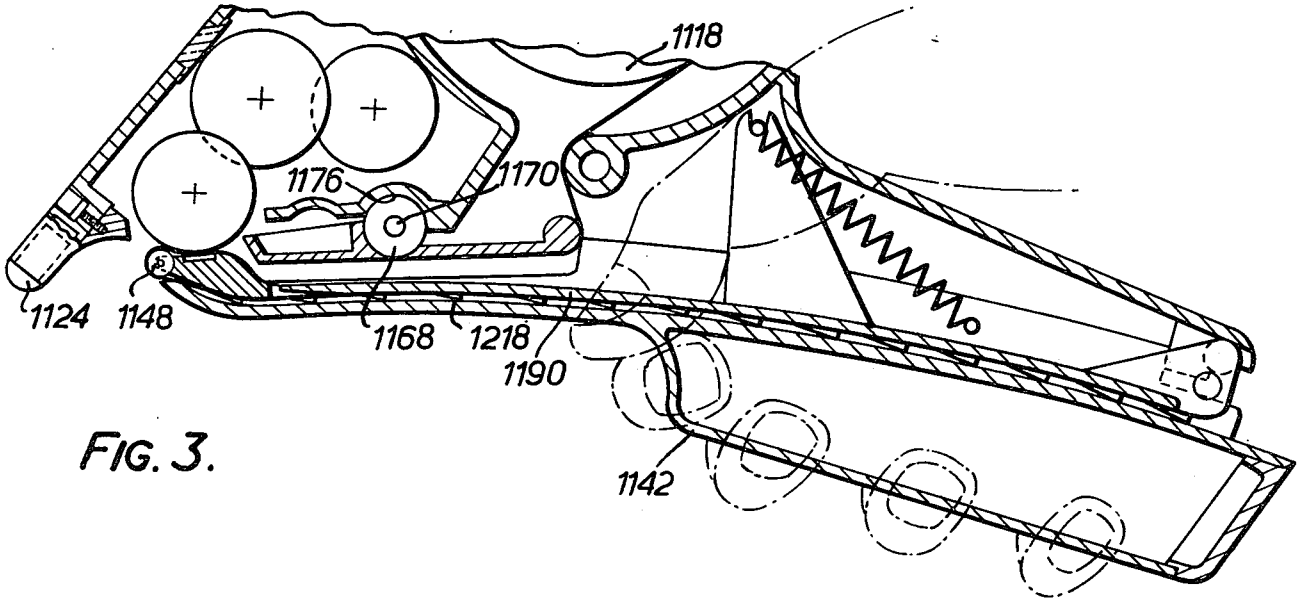
FIG. 3 is a view corresponding to FIG. 1 with the working parts adjacent their rearmost positions and a label about to be dispensed being printed, and showing how the applicator can be held in the hand.

The surface of the handle portion 1112 is contoured so that the applicator can be manually held in the manner shown in FIG. 3, i.e. with this surface in the palm of the hand. Adjacent its rear end the handle portion is provided with a pair of depending members 1138 each having a partly-open circular aperture 1140 therein.

A label dispensing and feed mechanism, which is reciprocably slidably movable with respect to the casing 1110, comprises a trigger 1142 and an inking and guide assembly 1144 incorporating a feed slide which is pivoted on the front end of the trigger 1142 by a spindle 1146 which also mounts a label-detaching roller 1148. The trigger 1142 is also desirably contoured as shown so that the user can conveniently place his index finger in the curved portion 1149 and his other fingers where indicated in broken lines in FIG. 3. As the action of the applicator is light, the user may choose to use his index finger only.

The assembly 1144 includes a nose portion 1150 mounting the spindle 1146 and having two pairs of barbs 1152 at the longitudinal edges of the undersurface thereof. The portion 1150 has a lower trailing part having a central slot 1154 therein, on either side of which slot a respective one of the rearmost pair of barbs 1152 is mounted. A printing platen 1156 is mounted on the upper surface of the nose portion 1150.

The remainder of the assembly 1144 is spaced from the nose portion 1150 to form a channel 1158 and is provided with a recess 1160 containing an ink pad 1162 and with a trailing extension 1164 having a circular section end portion 1166. Between the ink pad 1162 and the portion 1166 a roller 1168 is rotatably mounted on a pin 1170.

Figures 1, 2:
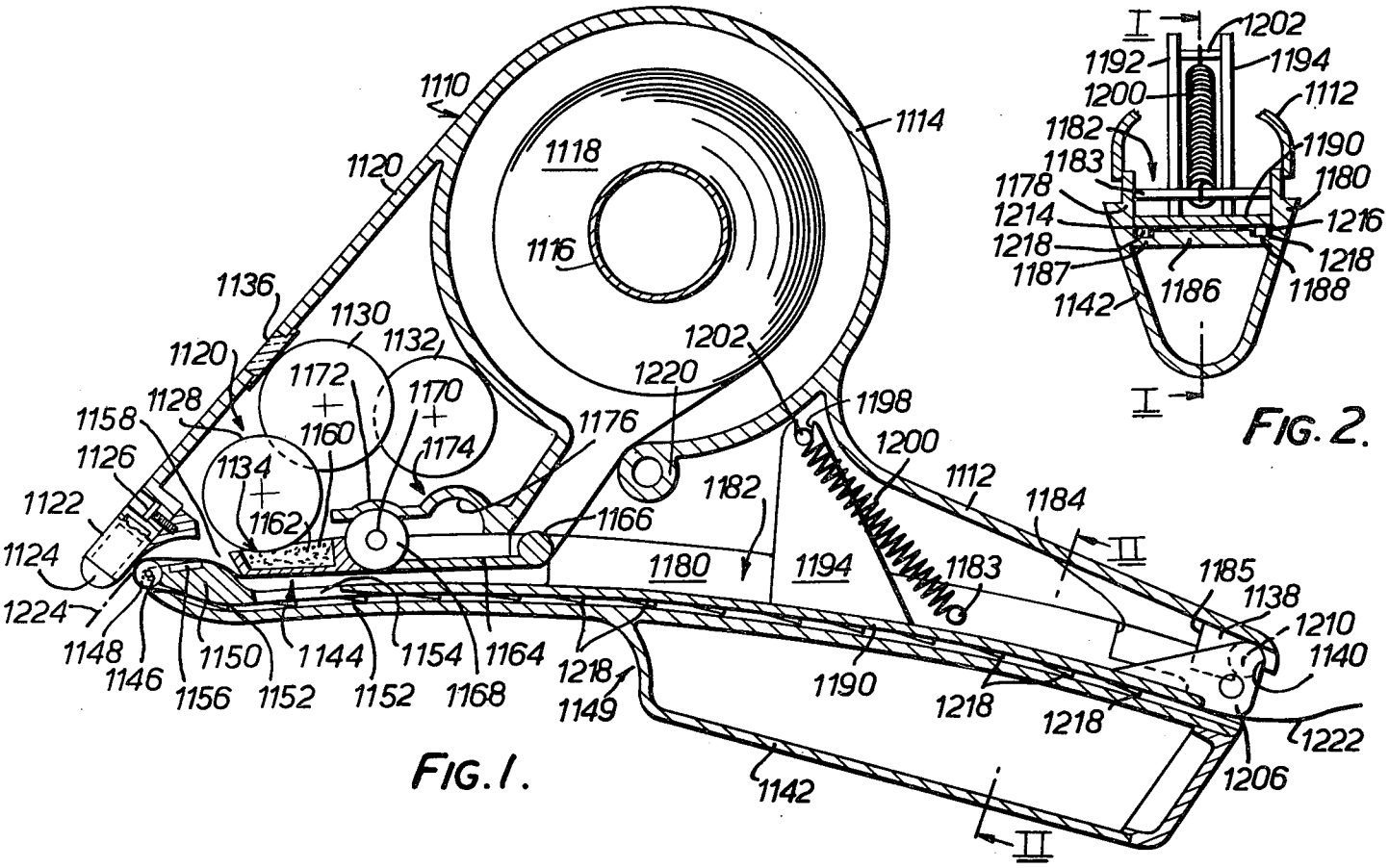
FIG. 1 is a longitudinal section of the embodiment in its rest position on the line I—I of FIG. 2, with certain parts omitted.
FIG. 2 is a section on the line II—II of FIG. 1.

In the rest position of the applicator as shown in FIG. 1, the operative facets 1134 of the print wheels 1128 are in engagement with the ink pad 1162 and the roller 1168 is seated in a notch 1172 in a portion 1174 of the casing 1110. In the position of FIG. 3, in which the trigger 1142 is at its rearmost position, the print wheels 1128 lie opposite the platen 1156 and the roller 1168 is seated in a second, deeper notch 1176 in the portion 1174.

Figure 4:
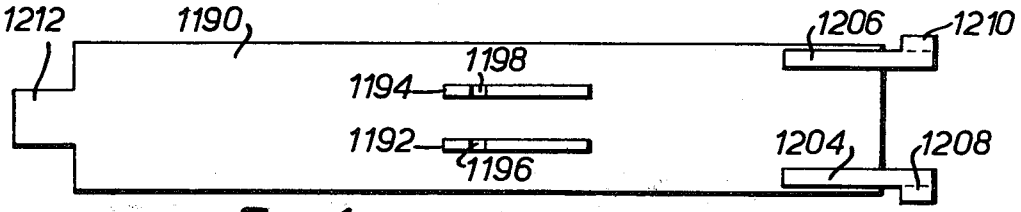
FIG. 4 is a top plan view of a tongue member used in dispensing means of the applicator.

The trigger 1142 has two side walls 1178, 1180 which define a channel 1182 which is arcuate longitudinally and of a generally rectangular cross-section. A transverse pin 1183 is mounted at opposite ends in walls 1178, 1180. Rear portions of the walls 1178, 1180 are cut away to define abutment surfaces 1184. These surfaces abut, when in the rearmost position, the surfaces 1185 of the depending members 1138 of the handle portion 1112. Meeting of the surfaces 1184 and 1185 limits the movement of the trigger 1142 with respect to the casing 1110. A central portion 1186 of the bottom surface of the channel 1182 is raised to define two smaller, similar channels 1187, 1188 adjacent its edges. A tongue member 1190 (FIG. 4), having a width slightly less than that of the channel 1182 and of the same arcuate configuration, is an easy sliding fit in the channel 1182.

The tongue member 1190 is in the form of an arcuate strip and has a pair of triangular flanges 1192, 1194 arranged symmetrically on the upper surface thereof, each such flange 1192, 1194 having a respective U-shaped slot 1196, 1198 in the free end thereof. A helical spring 1200 has one end attached to a pin 1202 fitted between the two slots 1196, 1198 and the other end attached to the pin 1183 extending across the channel 1182 on the upper surface of the trigger 1142. The spring 1200 serves to bias the trigger 1142 against reciprocal movement from the position shown in FIG. 1 to that shown in FIG. 3. It also urges the trigger 1142 and the tongue 1190 together so as to keep the backing strip locked therebetween.

The tongue 1190 has two other triangular flanges 1204, 1206 upstanding from the upper surface thereof carrying respective circular pegs 1208, 1210 on their outer surfaces which are supported in the apertures 1140 in the members 1138 of the handle portion 1112, whereby the tongue 1190 is free to pivot to a limited extent with respect to the casing 1110.

The leading edge of the tongue 1190 has a portion 1212 (FIG. 4) of reduced width which fits into the slot 1154 in the lower trailing part of the nose portion 1150 of the inking and guide assembly 1144 when the trigger 1142 is drawn back as shown in FIG. 3.

The configuration of the undersurface of the tongue 1190 can best be seen from FIG. 2. It is generally flat but has depending flanges 1214, 1216 which seat, respectively, in the channels 1187, 1188 in the floor of the channel 1182 in the trigger 1142. The tongue 1190 has, adjacent to the flanges 1214, 1216 a series of equally spaced barbs 1218. The barbs 1218 are similar to barbs on the inking and guide assembly 1244 and the barbs of each series are mutually spaced by the same distance.

The web is led from the reel 1118, with the label side uppermost, around a guide portion 1220 of the casing 1110, around the portion 1166 of the assembly 1144, along the lower surface of the trailing extension 1164 of the assembly 1144 and the part of the assembly mounting the roller 1168 and the ink pad 1162 up through the channel 1158 and around the roller 1148 where labels are detached. The backing strip only is then fed below the nose portion 1150 of the assembly, between such nose portion and the trigger 1142, and then along the floor of the channel 1182 in the trigger 1142 below the tongue 1190. The spent backing strip is discharged at 1222.

In operation, initially the applicator is in the configuration shown in FIG. 3, where the barb series 1152 and 1218 engage the backing strip. The operator then moves his fingers rearwardly with respect to his palm causing the trigger to move rearwardly with respect to the casing 1110 towards the configuration of FIG. 3. As the barb series 1152 is engaged with the trailing edges of respective pairs of notches in the backing strip, the backing strip is entrained by this rearward movement. There is no movement of the strip with respect to the dispensing roller 1148. The backing strip slides past the barbs 1218 which are angled in the correct direction for this to happen. The barbs 1218 stay in substantially the same position with the rearwards movement as the tongue 1190 pivots only slightly with respect to the casing 1110.

As the trigger 1142 moves rearwardly, the roller 1168 disengages from the notch 1172 and moves along the flat surface between the notches 1172 and 1176. The resultant slight anti-clockwise pivotal movement of the trigger 1142 and the tongue 1190 is accommodated by the pivoting of the tongue. The ink pad 1162 is moved out of engagement with the print wheels 1128.

The rearward movement continues until stopped by contact of the surfaces 1184, 1185. This occurs when the roller 1168 is engaged in the notch 1176, as shown in FIG. 3. The notch 1176 has a depth such that, as the roller 1168 engages therein the print wheels 1128 are urged into contact with the label on the platen 1156, located just in advance of the dispensing roller 1148, and sandwiched therebetween. The label 1224 which is about to be dispensed thus has the selected characters printed thereon.

To dispense this label the grip is relaxed so that the spring 1200 returns the trigger 1142 towards the configuration of FIG. 1. Owing to the reversed movement the barb series 1218 lock the backing strip with respect to the tongue 1190 and therefore, as the strip cannot move backwards, the label web is pulled around the dispensing roller 1148 as the roller is urged back against the web. The spent backing strip will slide over the barb series 1152 during this movement as they are moving with respect to the backing strip in the correct direction for this to happen.

In the configuration of FIG. 3 the label 1224 may have its trailing edge still adhering to the backing strip, or the trailing edge may be secured solely to the leading edge of the next label on the strip by the self-adhesive layers of the two adjoining labels.

The stroke of the trigger 1142 is chosen so that the web advances by one label length. The barb series 1152 and 1218 are so arranged that the web registers with the print wheels and the dispensing roller. This being so, the extremely positive drive provided by the barb series 1152 locking the web and the barb series 1218 thereafter feeding it by a precise amount obviate the disadvantages of creeping registration loss experienced by some previously proposed machines.

To apply the just-dispensed label to an article, the lower, self-adhesive side of the label is wiped on to the surface of the article and, in the same action, it is pressed into contact with the surface by the applicator pad 1124.

To load the applicator with a fresh reel, a removable side piece (not shown) is detached to allow access to the label reel store portion 1114. An end of the reel is then fed through by hand until it emerges adjacent to the label detaching roller 1148. The free end is then fed underneath the nose portion 1150 of the inking and guide assembly until it engages with the barbs. Loading can then be completed by a few reciprocating operations of the trigger.

Dispensing means other than the roller 1148 can be employed, for example a pin, fixedly or rotatably mounted in the nose portion 1150, as also can a fixed dispensing edge. Further the label application pad can be replaced by a plain or grooved edge or a transversely arranged series of longitudinally-extending fixed fingers.

With the exception of the springs and certain parts of the print head assembly, the applicator described herein is manufactured from synthetic resin of appropriate strength.

I claim:

1. In a label applicator, a casing, a label-carrying web store mounted on said casing, a print head assembly mounted within said casing for printing labels withdrawn from said store, means adjacent said print head assembly for detaching a label printed by said print head assembly from the web, a first member having barbs thereon and a platen surface which serves to support a label during the printing operation, said first member being movable relative to said casing and arranged to have its barbs engage the web, a second member having barbs thereon and mounted for limited pivotal movement relative to said casing, and actuating means operable to actuate said first barbed member in one direction to draw a fresh length of web over the barbs of said second barbed member during a first part of a working cycle, and to bring a label carried by said first member into contact with said print head assembly to print that label, said first barbed member being movable in the opposite direction during the second part of the working cycle, causing the fresh length of web to engage the barbs of said second barbed member, and draw a length of web from said store equal to one label length and simultaneously detach the label printed during the first part of the working cycle from the web by passage of the web over said detaching means.

2. An applicator according to claim 1 comprising
an ink pad movable with said actuating means and
a cam arrangement serving to bring said ink pad into contact with operative print facets of said print head assembly during one part of the cycle and to bring said print facets into contact with a label during another part of the cycle.

3. An applicator according to claim 2, wherein said cam arrangement comprises a roller mounted adjacent said ink pad and means defining two part-cylindrical depressions, said last-named means being rigid with said casing and said depressions being complementary to said roller.

4. An applicator according to claim 1 wherein said actuating means comprises a slide having a finger-engageable projection and grooves accommodating the barbs of said second barbed member.

5. An applicator according to claim 1, wherein said casing comprises a part detachable from the remainder of said casing, said part serving to mount said print head assembly.

6. An applicator according to claim 1 wherein said label detaching means comprises a roller mounted on said platen.

7. An applicator according to claim 1, wherein said second barbed member is of elongate arcuate form and is pivoted to said casing at the end remote from said first barbed member to enable said second member to make limited pivotal movements.

8. In a label applicator
a casing having
a label web reel carrier and
means defining an arcuate track,
means for applying a label dispensed from the applicator on to an article,
a slide member of arcuate shape slidable in the arcuate track of the casing and
carrying a trigger-like actuating projection,
an elongate arcuate barbed member carried by the casing and
carrying two series of barbs, one series being disposed adjacent each longitudinal edge of the arcuate barbed member,
a platen on which a label about to be dispensed can be printed,
said platen being mounted on the slide member adjacent the applying means and carrying
barbs arranged in two series corresponding to those of the arcuate member to engage a label web and
a dispensing edge for detaching from the web successive printed labels,
printing means mounted in the casing and
ink pad means mounted on the slide member,
said ink pad means carrying a cam follower cooperating with a cam arrangement,
the follower acting during a rearward stroke of the slide member to ink operative print facets of the printing means by contacting those facets with the ink pad means and to print a label on the platen by bringing the inked facets into contact with the label and the barbs of the platen serving to draw the web rearwardly so that a fresh length of web is presented to the arcuate barbed member, the arcuate barbed member serving on a forward stroke of the slide member, to draw from the reel a length of web equal to one label pitch and to detach a printed label from the web by drawing it over said dispensing edge.

* * * * *